United States Patent [19]

Wesley

[11] 4,345,650

[45] Aug. 24, 1982

[54] PROCESS AND APPARATUS FOR ELECTROHYDRAULIC RECOVERY OF CRUDE OIL

[76] Inventor: Richard H. Wesley, P.O. Box 218429, Houston, Tex. 77218

[21] Appl. No.: 139,438

[22] Filed: Apr. 11, 1980

[51] Int. Cl.[3] ..... E21B 43/25

[52] U.S. Cl. ..... 166/249; 166/63; 166/65 R; 166/177; 166/271; 166/299

[58] Field of Search ..... 166/248, 249, 250, 271, 166/299, 308, 311, 63, 65 R, 177; 175/16

[56] References Cited

U.S. PATENT DOCUMENTS

| | | | |
|---|---|---|---|
| 3,180,418 | 4/1965 | MacLeod | 166/177 X |
| 3,500,942 | 3/1970 | Smith, Jr. | 175/16 |
| 3,544,165 | 12/1970 | Snedden | 175/16 X |
| 3,708,022 | 1/1973 | Woodruff | 175/16 |
| 4,074,758 | 2/1978 | Scott | 166/249 |
| 4,164,978 | 8/1979 | Scott | 166/249 |
| 4,169,503 | 10/1979 | Scott | 166/249 X |

*Primary Examiner*—James A. Leppink
*Assistant Examiner*—George A. Suchfield
*Attorney, Agent, or Firm*—Gunn, Lee & Jackson

[57] ABSTRACT

Process and apparatus for electrohydraulic recovery of crude oil wherein an explosive, ablative electric spark is generated at or near a subsurface oil bearing formation and which generates shock waves and hydraulic waves that radiate or propogate outwardly into the formation and cause forcible migration of oil toward adjacent collection wells. Electrical energy, which is well within the load-carrying capacity of an electrical service cable extending into the well, is stored at or near the level of the oil bearing formation by a capacitor bank. A spark gap across electrodes is broken down by discharging current from an injector capacitor bank after which a current of substantial magnitude is discharged from a main capacitor bank into the broken down spark gap, thus generating the explosive spark.

21 Claims, 11 Drawing Figures

PROCESS AND APPARATUS FOR ELECTROHYDRAULIC RECOVERY OF CRUDE OIL

FIELD OF THE INVENTION

This invention relates generally to the recovery of crude oil from oil bearing earth formations and more specifically to recovery of crude oil that cannot be efficiently pumped or recovered by known secondary recovery processes. Even more specifically this invention is directed to a process for recovery of crude oil in which electrically generated shock and hydraulic waves are introduced into the oil bearing formation and function to alter the molecular structure of the formation, break the bond between the crude oil and the formation material and propagate the crude oil through the formation for recovery from adjacent wells.

BACKGROUND OF THE INVENTION

New processes are continually being sought to increase the recovery of oil. Reservoirs in the U.S. have produced more than ten billion barrels of oil and are estimated to contain over 90 billion barrels in place. If deposits which have little or no production history were included, the total remaining oil is estimated to be in excess of 150 billion barrels. Total oil recovery cannot be realized either in natural water drives or secondary recovery waterflooding operations. This condition is because water films bridge the gaps between sand particles, or close off the pore channels in the formations, after trapping the oil. At this time there is no way to tap the potential recovery discussed. The most difficult task anticipated is the recovery of heavy crudes. The incentive for developing a process that will include high viscosities in its capabilities is easy to illustrate. There are more than 1500 fields in 20 States containing heavy crudes alone. The present invention is directed to a system that will enhance production of all viscosities of crudes.

The adhesion of oil and water to surfaces of sandstone impedes the flow. Sometimes oil exists in reservoirs as individual droplets. Hence, there is little or no reservoir pressure which could be used to force the oil toward a well in the formation. Also, the oil is frequently so viscous that it has few of the characteristics that a completion engineer would consider desirable. It is desirable therefore to provide a dual force that will separate the pockets of crude from their individual places and force the resulting free material to a well bore. This dual force must be capable of propagating effective energy over an extensive subsurface zone in order that the entire area of the oil bearing formation may be produced. Further, the energy must be capable of being brought to the formation through an eight-inch well bore thousands of feet deep. For collection, the oil must be forced through the formation by the energy. A suitable technique for applying energy that alters the distribution of fluids in a formation influences the flow characteristics and hence improves recovery. It is to this end that the present invention finds its direction.

Since a large percentage of the oil remains in the reservoir after primary and secondary treatment, even relatively small recovery would be desirable. If only an additional 10 to 15 percent could be removed, it is obvious that the profit resulting would be exceptional. Calculations in accordance with the present method indicate that as much as 70 to 80 percent of the oil can be brought to well bores for production. This estimate is for most primary reservoirs that may be lacking reservoir energy. Under such conditions what was initially considered as marginal production with conventional techniques can prove to be a lucrative effort. Of course, porosity and permeability must be present along with saturation. But indications are that low permeability can be improved substantially by removing blockage, whether it be water or cementing between sand grains of the formation. This fact means that cementing material can be broken down and even fractured by an appropriate shock front, thereby increasing permeability. In accordance with the present invention, an infinite selection of shock waves and their energy can be made and adjusted to the particular subsurface condition. In this way preliminary treatment can be followed by oil movement.

In appraising a potential operation it is necessary to make simplifying assumptions because of the complicated nature of the many factors affecting performance. For example, consider the Buckrange reservoir, Stephens Field, Arkansas. Over 100 million barrels of oil remain in the reservoir that cannot be recovered by primary producing methods. The reservoir is about 2100 feet deep and its structure is a low dipping, southeast-plunging nose or terrace. The Buckrange sandstone (Upper Cretaceous) is terminated on the north and northeast sides by a fault and shales out in the other directions. The sandstone is fine grained and contains varying amounts of shale. Porosity, permeability and water saturation are variable. The average net porosity is 31 percent, the average net permeability is 92 millidarcys, and the average interstitial water saturation is 43 percent. The volume of stock-tank oil initially in the reservoir was estimated to be 126 million barrels, or 1,284 barrels per acre foot. Primarily, production has amounted to only 94 barrels per acre foot on a field-wide basis since its discovery in 1922. Theoretical calculations on a water flood indicate that a maximum of 278 barrels of flood oil per acre foot may be recovered by an efficient flood. Actual recovery, however, should be less than this. In this type reservoir the shock wave technique of this invention is calculated to produce approximately 900 barrels per acre foot. This is about 75 percent additional oil production after primary as compared to an estimated 23 percent additional recovery from an efficient water flood. In theoretical calculations, such as were used, the permeability-saturation relationships, saturation gradient, geometry of the system, etc. affect the time element in estimating recovery. In linear flow the geometry is less complex than in radial flow. Also, when deviation from the true radial characteristic is considered, the complexity is compounded. As more variables are included, computer time becomes essential.

In order for a secondary recovery technique to be desirable, certain economic guidelines must necessarily be considered. It is desirable that present wells be utilized to gain access to the oil bearing formation by energy generating apparatus. The apparatus therefore should be capable of passing through a conventional drill collar to eliminate any need for expensive enlargement of the well bore. The process should be economical in comparison with prices in the crude market, should develop the equivalent of thousands of horsepower, and be so controlled that it is non-destructive. The energy source should be inexpensive and should be reusable many times in order to enhance the commercial aspects of the recovery method.

THE PRIOR ART

Various attempts have been made in the past to accomplish production of oil from oil bearing formations by means of sonic wave generation. Sonic wave generation in the broad sense is set forth in U.S. Pat. Nos. 3,302,720; 3,923,099 and 4,022,275 of Brandon. Accoustic wave generation for accomplishing production of oil is disclosed in U.S. Pat. Nos. 2,871,943 of Bodine; 3,842,907 of Baker et al; 3,965,982 of Medlin; 3,990,512 of Kuris and 3,743,017 of Fast et al. Other wave form responsive oil production systems are disclosed by U.S. Pat. Nos. 3,527,300 of Phillips and 3,754,598 of Holloway. An electrically energized sonic wave tertiary crude oil recovery process is disclosed in U.S. Pat. No. 4,060,128 of Wallis.

One of the most important aspects to which the present invention is directed is the requirement for generation at or near the level of the oil bearing formation involving a sonic wave front of extremely powerful, explosive and ablative nature so as to develop sufficient energy projecting a great distance into the formation involved in order to stimulate significant recovery of the oil from the formation. In view of the fact that electrical supply cables will need to extend many thousands of feet from the surface to the location of the oil bearing formation, it is extremely difficult to transmit sufficient electrical energy through the cable to develop the desired explosive spark activity without causing energy damage to the cable itself. Accordingly, it is a primary feature of this invention to transmit electrical energy through a supply cable at a rate well within the capacity of the supply cable and to develop an electrical potential at or near the level of the oil bearing formation, which electrical potential is many orders of magnitude greater than the electrical supply level involved and then to release this stored energy in the form of an explosive spark, thus developing the desired characteristics of energy projection into the formation.

It is also a feature of the present invention to provide a novel method and apparatus for recovery of crude oil wherein shock waves and hydraulic waves are generated in the oil bearing formation and function to induce oil to migrate to adjacent well bores for collection.

It is a further feature of this invention to provide a novel method and apparatus that has the capability of altering the molecular structure of the oil bearing formation and causing release of oil therefrom.

It is also a feature of this invention to provide an electrical system for transmitting electrical energy through a cable of considerable length at an acceptable rate that is within the effective energy transfer capacity of the cable and developing an electrical potential of much greater magnitude at the level of the oil bearing earth formation and also having the capability of suddenly releasing the stored electrical energy in the form of an explosive-like energy discharge that develops a sonic wave front that travels through the earth formation.

It is an even further feature of this invention to provide a novel method and apparatus for recovery of oil wherein strain pulses are generated in the oil bearing formation and cause fracturing to occur by means of instantaneous raise in stress level in the formation, resulting in more drainage of oil for migration through the formation.

Another feature of this invention includes the provision of a novel method and apparatus for oil recovery, wherein shock waves, the amplitude, shape and duration of discharge frequency thereof are adjustable in conformance with the density and other characteristics of the oil bearing formation and the viscosity and other characteristics of the oil and other fluids contained within the formation.

It is also an important feature of this invention to provide apparatus for generating shock and hydraulic waves in oil bearing formations wherein narrow wave fronts may be controllably oriented so as to ensure extensive shock wave propagation through the formation and thus energy generated oil migration at great distances from the point of energy generation.

It is an even further feature of this invention to provide apparatus for recovery of oil that is capable of being inserted through typical well pipe and thus may be simply and efficiently employed without necessitating drilling of additional wells.

It is also a feature of this invention to provide a novel method and apparatus for oil recovery which is simple in nature, reliable in use and low in cost.

Other and further objects, advantages and features of this invention will become obvious to one skilled in the art upon an understanding of the illustrative embodiment about to be described and various advantages, not referred to herein, will occur to one skilled in the art upon employment of the invention in practice.

SUMMARY OF THE INVENTION

The equipment for accomplishing oil recovery in accordance with this invention includes a generator and a well logging winch truck of conventional design which are commercially available and are not considered part of the system to be described. The electrohydraulic stimulator system consists of a subsurface unit or sonde which is connected to and supported by the winch truck cable, and a control panel at the surface to which the upper end of the well logging cable is connected. Power for the energy storage and control circuits in the sonde is supplied by the electrical conductors in the well logging cable. The power is obtained from the generator and is distributed to the cable by the surface control panel. Controls on the panel may be manipulated by the operator to obtain system performance appropriate to the borehole situation. In accordance with this invention, the principle of electrohydraulic oil recovery may be summarized as follows: An oil bearing rock formation penetrated by a borehole may be stimulated by a shock wave generated by an explosion in the borehole fluid produced by an electric arc between a pair of electrodes. In one form of the invention the electrodes may be mounted in a focusing cavity of the sonde so that the energy of the explosion is radiated in a focused and concentrated energy wave. The focusing cavity may be part of a rotating member of the sonde so that the shock wave may be directed in all angles sequentially. The energy for the electric arc is obtained from a capacitor bank contained within a housing that is positioned in the well bore at or near the level of the oil bearing earth formation, and which may be discharged into the electrode gap very rapidly as compared to the much slower charging rate of the capacitor bank so that a high ratio of peak output power to average input power may be realized.

In another form of the invention, the housing is fixed and the explosive energy generated radiates outwardly therefrom. The entire housing and its support structure may be rotated, if desired.

A power supply cable, which is of reasonably restricted dimension and capacity, is employed to conduct electrical energy from appropriate supply sources such as generators, power lines, etc., from the surface environment to the downhole environment at or near the level of the oil bearing formation involved. This electrical energy is then transmitted into the sonde and is utilized to charge a capacitor bank and thus store the electrical energy to develop an electrical potential that is many orders of magnitude greater than the electrical energy carrying capacity of the electrical supply cable. The stored electrical energy in the main capacitor bank of the sonde is then suddenly unloaded into the spark channel, such unloading being accomplished in the order of about 10 microseconds, thereby causing an extremely violent, ablative explosion and shock wave that is transmitted through liquid coupling the sonde to the formation and thence into the formation in the form of a sonic wave.

The function of the system is controlled by a fire control circuit operated from a control panel that consists of a fire control module and a rotation control module which obtain input power from the generator. The control panel is connected to the subsurface sonde by means of a three conductor well logging cable or other suitable electrical conductor system. The fire control module includes an AC controller which supplies power under controlled conditions over line 1 of the cable to the firing circuit in the sonde. The firing circuit controls the charge and discharge of the energy storage capacitor bank. The fire control circuit in the control panel generates a signal which triggers the discharge function of the firing circuit. This signal is supplied to the sonde on line 2 of the cable. A monitor signal, indicative of the voltage on the capacitor bank, is supplied by the firing circuit to the fire control circuit on line 2 of the cable. This is used by the AC controller in the control panel to automatically limit the capacitor bank voltage to a value set on the control panel. Where a rotation function is desired, the rotation control module supplies motor power and control signal to the sonde on line 3 of the cable. The motor controller in the sonde switches the motor on or off in response to the signal generated in the rotation control module. The rotation sensor in the sonde generates a signal which indicates a change in the angular position of the rotatable head of the sonde. This signal is supplied to the rotation indicator in the rotation control module on line 3 of the cable. Under circumstances where a rotatable firing head is not desirable, the structure and circuitry of the sonde may be simplified. The spark head, however, will be designed to radiate shock waves and hydraulic waves in omnidirectional manner.

In operation, the sonde is suspended in a borehole at the desired depth by the well logging cable. In the manual operating mode the capacitor bank can be discharged into the electrode gap by operation of a manual fire control button or by an automatic firing sequence. Each operation of the button will produce one shot. After each shot the capacitor bank will recharge to the predetermined voltage. If a shot is attempted before this voltage is reached in the recharge phase, the shot will be automatically prevented. The capacitor recharge time is dependent on the voltage, the size of the capacitor bank, and the power limitations in the charging circuit. The rotatable head may be activated by a manual control or by an automatic rotation sequence, if desired. Rotation of the head will be indicated by a digital register which counts increments in the angular position of the head. In order to stimulate a thick oil bearing formation a shot pattern can be fired at regular vertical spacing. While the head may be advanced and fired under manual control, an automatic operating mode is provided in which a shot is fired once for each specified change in angular position. If the sonde is moved vertically in the borehole while the head is continuously rotating and firing, a uniform helical shot pattern can be obtained.

By using energy which functions at the molecular level, the energy induced into the formation will cause the capillary-sized portions of oil to release from their adhesion to the formation and flow. The energy source is unique in that it uses both sonic and hydraulic force. Electric discharge at a spark gap in a sonde lowered into an input well causes pressure and shock waves that enable the crude to be collected at other well bores nearby. Regardless of the structure of the sonde, suitable explosive-like spark energy is developed at or near the level of the production formation. A capacitor bank located in the sonde is charged slowly to prevent overloading of the service cable and the stored electrical energy is then suddenly released from the capacitor bank to develop an explosive spark of significant magnitude for enhancing production of oil.

BRIEF DESCRIPTION OF THE DRAWINGS

In order that the manner in which the above-recited advantages and objects of the invention are attained, as well as others, which will become apparent, can be understood in detail, more particular description of the invention, briefly summarized above, may be had by reference to the specific embodiments thereof that are illustrated in the appended drawings, which drawings form a part of this specification. It is to be understood, however, that the appended drawings illustrate only typical embodiments of the invention and therefore are not to be considered limiting of its scope, for the invention may admit to other equally effective embodiments.

In the Drawings

DETAILED DESCRIPTION OF PREFERRED EMBODIMENT

As mentioned above, it is desirable to produce crude oil from many oil bearing earth formations that are inefficiently responsive to known primary and tertiary crude oil production techniques. In accordance with the present invention it has been determined that substantially simultaneous introduction of shock waves and hydraulic waves into an oil bearing formation will cause crude oil to break its adhesion with the formation and migrate in a direction away from the point of introduction. This migrating crude oil is then produced in conventional manner from adjacent wells due to migration induced concentrations of crude oil then present at adjacent wells.

Figure 1:
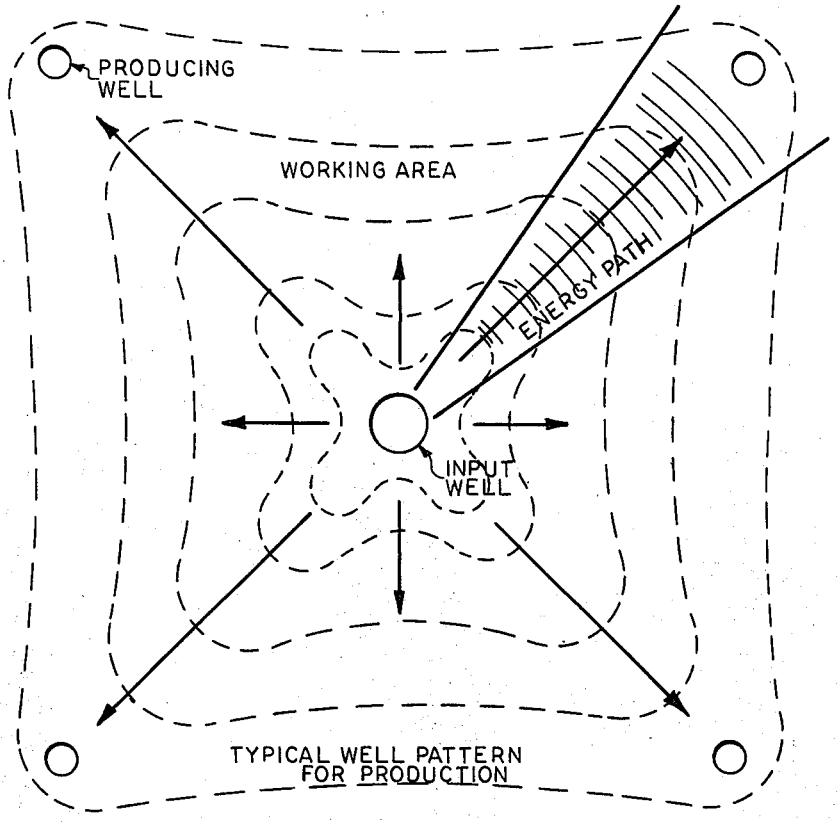
FIG. 1 is a schematic plan view of a well pattern that may be employed to produce oil in accordance with the present invention.
Figure 2:
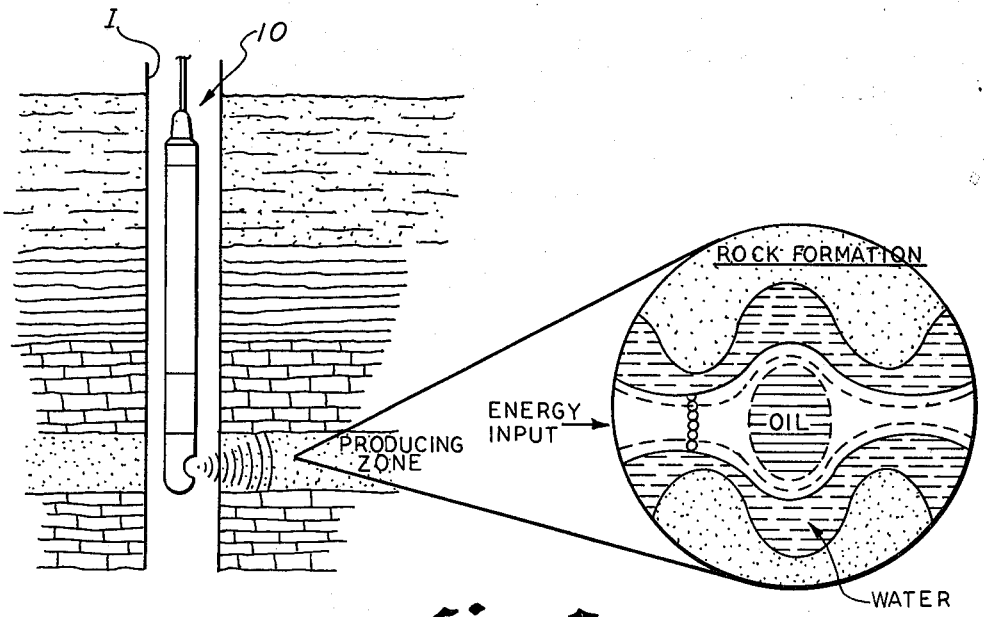
FIG. 2 is a schematic illustration in vertical section illustrating a typical well bore in an oil bearing formation and showing by way of an enlargement wave induced propagation of oil through the formation.

Electrical energy is rectified and stored at or near the production formation level by means of a capacitor bank circuit and the stored high voltage electrical energy is then suddenly released across a spark gap and develops an explosive-like ablative spark pulse from the capacitor bank releasing energy from the spark for radiation into the formation. For maximum shock and hydraulic impact to the formation, means is provided to direct the radiating shock and hydraulic waves in narrow angle wave form into the formation. As shown in FIG. 1, a subsurface unit or sonde is shown generally at 10 which is oriented in such manner that released shock and hydraulic waves are directed into the oil bearing formation along a narrow angle energy path P from an input well I. Producing wells W are located in radially spaced relation with the input well I and are equipped with any suitable conventional crude oil production equipment, such as pump equipment, gas-lift equipment, etc. Although the production method described herein will function alone, it is anticipated that this invention can function quite efficiently in conjunction with other tertiary crude oil production techniques, such as chemical injection, for example. In addition to development of shock and hydraulic waves, the release of energy in narrow angle form also accomplishes fracturing of the formation and thus further enhances release of crude oil from the formation for forcible migration away from the input well. FIG. 2 illustrates forcible migration of crude oil by way of a pictorial representation shown in partial vertical section.

Energy advancing from the electric arc explosion is in the form of a shock wave and a hydraulic wave. The shock wave travels through the formation faster than the hydraulic wave and separates the adhesive bond of the crude and the formation. The hydraulic wave follows the shock wave and forces the crude oil into forward motion radiating away from the input well.

Timing of the pulse and the shaping of the shock and hydraulic waves are germane to the system. Control of the capacitor discharge can direct the waves as though the energy were beamed. Further, the frequency can be adjusted to the viscosity of various crudes and the density of each formation. The operator will be able to point and maximize the energy by appropriate controlling or adjustment of the electrical circuitry by manual positioning of adjustment dials on the control panel. The crude can be streamed or caused to migrate at the maximum rate for the conditions involved by further adjusting the electrical circuit. The resulting effect will be to gently move the crude oil through the formation in efficient manner. This principle of maximum force at the frequency of least resistance stimulates economical production of crude oil that otherwise cannot be efficiently produced by present methods.

The energy released in laboratory conditions has actually proven the ability of the shock waves to change the molecular structure of the formation material. Even such substances as iron have exhibited molecular changes which have not been observed before. The ability of this energy form to alter the lattice of atomic relationships will further free the crude oil and apparently decrease its viscosity. The resulting lower viscosity crude oil will be easier to migrate through the formation and raise by pumps or other means from adjacent production wells.

Fracturing can be considered as a method to make hard rock amenable to fluid extraction. As the strain pulse travels outward, its amplitude decays rapidly until no further fracturing occurs. The compressive strain pulse continues to travel outward until it is dissipated or reflected by a free surface. Upon reflection, the compressive strain pulse becomes a tensile strain pulse. As the strength of the rock in tension is much less than that is compression, the reflected tensile strain pulse is able to fracture the rock in tension. This effect occurs progressively from the free surface back toward the point of discharge. In oil bearing formation fracturing, it is important to select the wave form and energy level so that the degree of fracture and the resulting particles are small. The capacitor discharge effect can fracture subsurface formations and stimulate flow of viscous oil in oil bearing formations. The energy from a capacitor discharge can be controlled and directed to encourage movement of viscous oil to a well bore and fracture a formation. The technique involves sudden capacitor discharge of electrical energy into a spark gap to create a pressure pulse. The channel created by the spark explodes, thereby producing shock waves. The time of the generation of these pulses can be determined within millimicro-seconds to adapt the energy to the application. It has been determined by experimentation that virtually any type of rock can be fractured. By employing the capacitor discharge technique as an acoustic source, the dynamic elastic constant of rock can be determined and used with data on the formation. For example, an electrohydraulic rock crusher has been demonstrated which can even control the size of material produced. The same principle can be applied to subsurface material, and can develop shear waves up to 450 linear feet from the point of electrical discharge.

The energy developed by mechanical vibrations of sonic and ultra-sonic frequencies has unique properties that substantiate the desirable effects of the capacitor discharge technique. Research concerning sonic and ultra-sonic frequencies generally indicates that high frequency waves are attenuated too quickly in the formations and are of little effect and low frequency waves at high amplitude develop better flow, but tend to release debris which eventually restrict flow around the well bore.

The present production technique overcomes the problems met by the sonic approach by controlling, among other things, the frequency and amplitude. In this way, the operator can obtain maximum effective migration of crude oil to production wells while totally eliminating or substantially reducing the accumulation of debris at the production wells. It makes little difference whether the crude oil is high or low viscosity, therefore, its potential use can be extended to reservoirs of all kinds. This invention is especially useful where reservoir energy is insufficient to move the oil to the well bore.

The capacitor discharge, or electrohydraulic technique, is considerably different as compared to other production techniques insofar as there is the added benefit of explosion, cavitation and hydraulic pressure. Cavitation is defined as the breakdown of cohesion of a liquid when exposed to high tensile forces of sound. Also, in this case the wave shape, frequency, amplitude and duration will be controlled to stimulate efficiently controlled migration of production fluid through the formation to the production wells. The energy developed by mechanical vibrations of sonic and ultrasonic frequencies has unique properties and effects which can be considered a limited analogy with electro-hydraulic energy. Acoustic pressure generated within porous rock could add to the pressure to accelerate fluid movement. This much has been demonstrated, but at the present time the ranges of frequencies available in the capacitor discharge technique have not been considered. In addition, thhis phenomenon is accompanied by substantial hydraulic enhancement. Thus, the electro-hydraulic technique of this invention represents an entirely new source of energy for crude oil production. An intense shock is one of the most important effects. This shock wave, or pressure pulse, moves through the medium at a speed faster than sound. The effect is to produce a steep, almost instantaneous rise in stress at the points it reaches, delivering a considerable amount of energy to the formation.

In many respects, the behavior of a shock wave in a solid is much the same as it is in a gas or liquid, the chief difference being that the shock pressures attainable in solids are far higher than those attainable in gases, and appreciably higher than those obtained in liquids. The important quantities in shock wave physics are the velocity of the shock, the increment of velocity given the atoms or particles and the axial stresses which are the components in the direction of shock propagation.

The energy and some of its characteristics just considered can be contained, released and controlled in a downhole package. Only the control panel and 110/220 VAC source will be at the surface.

Since production will not be realized from the well containing the equipment, it will be well to consider a type of five-spot pattern used in waterflooding. The center or input well contains the equipment and the energy will be first locally directed toward one of the producing wells. With adjustment, one or more wells can be treated at one time. The formation with not be damaged in any way and the treatment can be repeated with greater and greater intensity as the formation depletes.

The sonde will be lowered down an input well so the discharge housing will be at the producing horizon. Controlled discharge will be directed into the formation for stimulation at frequencies and energy levels adjusted to suit production. The equipment remains in the hole as long as required.

The exploding spark channel is a potent and controllable energy source. If a high-voltage capacitor is quickly discharged into a channel whose initial resistance of the order of the low intrinsic impedance of the circuit, the high energy densities can be placed in the channel during the initial conduction period.

The channel created by the spark gap will produce wave causing deformations with such characteristics as travel time, wave length, absorption and direction. The tension produced by the shock wave is strong enough to cause more incredible phenomenon than fracture. It is possible with present technology to achieve shock pressures which produce very high strain rates and shear stresses close to the theoretical limit for short times in many rocks. It is thus clear that shock waves can alter the nature and properties of materials.

The effect described is by rapid release of energy stored in a high-voltage capacitor bank and its dissipation in a submerged fluid arc. The capacitors will operate down hole and, hence, will be located in housing small enough to pass through a section of drill collar. For compactness, and to reduce corona and arcing, the capacitors will be cylindrical and may operate at capacities as low as 3 KV and 100 mfd. The switch for discharging the capacitor bank will be a reliable and commercially available ignitron with low inductance. The transmission system may be coaxial cable for flexibility and low inductance.

Recording instruments will be used to evaluate the results of the pulse. Energy density will be recorded as a function of time and space to interpret geologic properties. The records will be essential in finding the characteristics of the strata, as well as noting changes that occur.

Laboratories conducting shock-wave experimentation have typically concentrated research generally in pressure and, consequently, there are many other avenues available for further development. For example, transient pressures as high as 9 million atmospheres have been achieved in shock wave experimentation. This is 3 times greater than the pressure at the earth's core, and about 18 times higher than the pressure than can be reached in static pressure-generating equipment. Shock pressures of such a magnitude drastically change electronic energy levels in solids, rearrange atoms in lattices and alter the equilibrium partition of energy in substances. Thus, such pressures—applied almost instantaneously, under controlled conditions—have yielded fundamental thermodynamic data (known as equation-of-state data) essential to every science for over 200 materials at pressures where data could not be obtained by any other means. Changes in crystal structure, permanent in some materials, transient in others, have been induced by shock. Shock-waves can also change electrical conductivity, making conductors out of such insulators as sulfur and paraffin. Shock-waves also release electrical charges from piezoelectrics, ferroelectrics and many insulator materials, proficiency measurable current in an external circuit.

In geophysics, shock-wave research in the laboratory has provided data concerning phase changes that may occur deep in the earth's mantle; and, in chemistry, shock-waves have contributed uniquely to understanding kinetics of fast reaction in gases. Although shock-waves are known in general, the precise definition is not so easy to formulate. The commonly used term refers to any almost-instantaneous increase in the value of stress or pressure in a material so long as the velocity with which the stress transition travels through the material is greater than the velocity of sound in its substance. One must also consider essential the fact that this stress transition travels through the medium. The abrupt transition itself is the compressive phase of the entire shock wave. Where the pressure falls off rapidly from its peak value to its pre-shock ambient value is identified as the rarefaction phase of the shock wave. Immediately ahead of this shock front at any instant, the material through which the shock is propagating remains undistributed. But an infinitesimal distance behind the shock front the material is in a shocked state; it is compressed to a higher density, and its constituent particles are accelerated. This additional particle velocity behind the shock added to its wave's propagation velocity, permits the rarefaction portion of the shock wave to travel faster than the shock front itself. Therefore, the rarefaction part of this wave gradually overtakes the shock front and the entire shock wave simultaneously lengthens and decreases in amplitude as it travels. The details of shock wave structure depend upon how the wave was generated, how far it has propagated, the geometry of wave generation and of the medium. It is this last that which is most often of interest, and in consequence, the attempt is made to generate incident shocks so that their detailed structure can be related to properties of its medium. In order to determine the amplitude (and ultimately the energy) of the transmittal wave, equations must be used which describe the effects of shock transition on both the mechanical and the thermodynamic status of the medium. These equations express the fact that mass, momentum and energy are conserved in the shock transition.

$$u_1=(p_x-p_o)/p_oU \quad (1)$$

$$U^2=V_o^2(p_1-p_o)/V_o^1-V_1) \quad (2)$$

$$u_1=[1-(p_o/p_1)]U \quad (3)$$

$$E_1-E_o=\tfrac{1}{2}(V_o-V_1)(p_1+p_o) \quad (4)$$

In these equations which apply precisely to a shock which connects two uniform states, indicated by the subscript "o" for an initial unshocked state and "1" for a subsequent shock state, "p" is the component of compressive stress parallel to the direction of shock propagation. Density is denoted by "p," and its reciprocal, the specific volume, by "V." The velocity of propagation of the shock wave relative to the unstressed material just ahead of it is "U." As mentioned above, the shock compresses material to a higher density and simultaneously increases its particle velocity by $u_l$. The work done on a unit of mass by this force driving this shock thus shows up as an increase in the internal energy per unit mass of the shock, $E_l$ along with an increase in kinetic energy. The last equation represents this energy conserved with kinetic energy eliminated by means of Equations 1 and 3. Equation 4, known as the Rankine-Hugnoniot relation, plays a key role in shock theory. Its particular importance depends on the fact that it contains no velocity terms, only thermo-dynamic quantities.

Whenever a solid body is subjected to a dynamically applied load, stress waves are generated, which then move through this body. Viewed simply, the dynamic load sets into motion the elements of this body against which it acts thereby changing the shape of each element. Each affected element in turn reacts with its adjacent elements, and these in turn with their adjacent elements. In this manner, the initial disturbance progresses through the body. From purely geometrical considerations, it can be shown that any change in the configuration of an element can be obtained through a change in volume and a distortion. Most solids behave nearly elastically when subjected to small forces, i. e. volumetric changes and distortion are reversible and vary linearly with the applied load. Application of Newton's laws of motion to such a mechanical system yields a differential equation which separates volumetric changes or dilatation waves from distortion or shear waves, with each wave traveling at its own characteristic velocity. If this material is further assumed to be mechanically isotropic, the dilatational wave velocity will be the same in all directions, and so will the shear wave velocity. These wave velocities can be related simply to the density and stiffness (resistance to deformation) of the material as given by:

$$C_L=[3K(l-v)/p(l+v)]^{\frac{1}{2}} \quad (5)$$

$$C_T=(G/p)^{\frac{1}{2}} \quad (6)$$

where $C_L$ is the dilatational or longitudinal wave; $C_T$ the shear or transverse wave velocity; K the bulk modulus of the material; p its density; G its modulus of rigidity; and v its Poisson's ratio, the ratio of lateral extension to vertical construction or vice versa.

In many important applications, the elastic constants, G, K and v, can be considered to remain constant, even though they do in fact depend upon the state of stress, a matter which has received much attention by experimental physicists. At very high pressures most materials behave as a plastic or fluid and, hence, are incapable of effectively transmitting shear distortions. If the material is mechanically anisotropic, a given type of wave will propagate at different velocities in different directions. Such situations have been studied extensively. In the wave interactions discussed here, it will be assumed that the bodies through which the waves move are composites of individual Hookean, elastic isotropic solids. The concern is principally with reflections and transformations that take place at the boundaries and interfaces between the different constituents of these rocks.

The velocity of dilatational waves generally range from approximately 7,000 to 20,000 feet per second. The shear wave velocity of a material is usually about one-half the dilatational wave velocity.

It can be shown from momentum considerations that for an elastic Hookean solid, the stress $\sigma$ and particle velocity V are linearly related through this equation:

$$\sigma=pCV \quad (7)$$

where p is the density of the solid and C, the velocity of transmission of the wave. This relationship applies to both shear and longitudinal waves. In a shear wave the particle velocity vector is normal to the direction of propagation of the wave; it is parallel to and lies in the same place as the shearing stress. For longitudinal waves, the particle velocity vector is normal to the wave front. If it is a tension wave, the sense of particle velocity is opposite to the direction of propagation of the wave; if it is a compression wave, the respective senses are the same.

Usually, the intensity of a wave at a point varies with time. The relationship in Equation 7 applies at any instant of time or any point along the wave. It can be used to describe particle velocity at any point as a function of time, to specify fields of particle velocities associated with transient waves; and to follow the motion of a point as a transient wave passes through it.

In discussing reflection and transmissions at a boundary, it is convenient to consider three categories of wave contact: Normal incidence, oblique incidence and 90° or grazing incidence. The behavior of a longitudinal wave at a boundary is quite different from that of a shear wave. A tensile longitudinal wave will not be felt across an unbounded interface, whereas a compressive longitudinal wave will generate waves on the other side of the interface. The front of a wave may be either plane or curved, and, if curved, may be either convex or concave.

The derivation of mathematical expressions for the amplitudes of the new waves in terms of the amplitude of the incident wave, the geometry of the encounter, and the physical properties of the materials involved, is straightforward, except for the case of the 90° grazing incidence. The boundary conditions that must be satisfied are: (1) continuity of stress normal to the interface and (2) continuity of particle velocity or displacement. The first of these is simply an expression of Newton's third law of motion, in which these forces are governed by the respective densities and elastic properties of the materials involved. The second condition merely states that the interface should hold together.

From the standpoint of several basic formulae involved in shock wave physics in solids, the important quantities to consider are (1) velocity of the shock, (2) the increment of velocity given to the atoms or particles, (3) density of the particles and (4) the axial stress. Since the laws of conservation of mass and momentum apply, these four quantities can be related by the simple Hugoniot equations; the initial density times the shock velocity is equal to the density under compression times the difference between the shock velocity and the particle velocity:

$$p_oV=p(U-u)$$

and the axial stress is equal to the product of the initial density, shock velocity and particle velocity $$\sigma=p_oU\mathrm{u}$$

for a given material initial density is fixed so that the equations contain four variables; measurement of any two of the variables makes it possible to compute the other two.

Relative to the energy source, the most potent and controlled is that of the exploding filament. It has been found that if a charged high voltage capacitor is very quickly discharged into a small well conducting filament whose initial resistance is of the order of the low intrinsic impedence of the circuit, high energy densities can be placed in the filament during the initial conduction period.

Very high energy densities have been obtained in exploded aluminum filament. For example, both the total energy $$E_t = \int_o^t |Vdt$$

as well as the resistive energy alone stored in the filament $E_r=\int |Vdt-\frac{1}{2}L_oI^2$. The filament inductance does not change rapidly so the neglect of this effect in the stored energy is small.

The observed times for the luminous zone to achieve its terminal velocity of 9 km/sec is about 10 mu sec. The acceleration then is:

$$a = \nabla v/\Delta_t = \frac{9 \times 10^3}{10 - 8} = 9 \times 10^{11}\ \mathrm{m/sec^2}$$

For a mass of vapor of 10 ugn, the force is:

$$f=ma=(10\ ugm)\times 9\times 10^{13}\ \mathrm{cm}=9\times 10^9\ \mathrm{dynes}$$

Assuming that a force acts over an area of $6\times 10^{-3}$ cm$^2$ ($\frac{3}{4}$ cm long and 1 mm. dia.) the pessure is $P=1.5\times 10^{11}$ dynes cm$^2=1.5\times 10^5$ atmospheres.

This is a tremendous amount of pressure and it is released to the surrounding medium when the current ceases, the magnetic field collapses and the spark explosion occurs. This activity is referred to generally herein as spark detonation.

A properly shaped filament will produce stress waves causing deformations that are derived characteristics and phenomena such as travel time, wave length, absorption, refraction, reflection and the like.

The elastic wave-producing forces are associated with two types of strains, which are: (1) volume changes, including compression or dilation, and (2) shearing strains.

These two strains propagate in a homogeneous isotropic medium with constant but different velocities. Geologic formations encountered near the surface and in the interior of the earth are far from homogenous and isotropic. However, this can be allowed for by assuming continuous or discontinuous variations of the physical properties and by applying the theory to small elements of an elastic substance.

Sedimentary rocks show a marked difference in elasticity depending upon petrologic composition. Elastic sediments such as sands, sandstones and shales are less elastic than sediments composed partly or wholly of crystalline matter such as limestones, dolomites, etc. Elastic properties of sedimentary rocks depend much more on texture and geologic history than on mineral composition.

The effect of porosity and decomposition is to increase the modulus of elasticity and the wave velocity of a sediment. In areas of great thickness of sedimentary rocks, the porosity decreases with depth. Therefore, the modulus of elasticity increases and with it the wave velocity. Related to changes of porosity is the various of Young's modulus with pressure. For small pressures, any cavities present have to be closed before the pressure can begin to act on the rock material itself. Excessive compressionabilities resulting from porosity are accompanied by high values of Poisson's ratio.

Many observations of elastic wave speeds appear to indicate a direct relation between geologic age and elasticity. The controlling factor is the amount of diastrophism to which the formation has been subjected in its geologic history.

The proper use and control of the energy is intimately associated with the initiating filament. So to provide more control, more efficiency and increased power, the basic ideas and designs as outlined in the referenced document will be followed.

A physical effect that is often encountered in shock wave investigation is the tension that arises at the point where a rarefaction wave that follows close behind the shock front. The tension is often strong enough to cause fracture, which leads to other possibilities.

Figure 3:
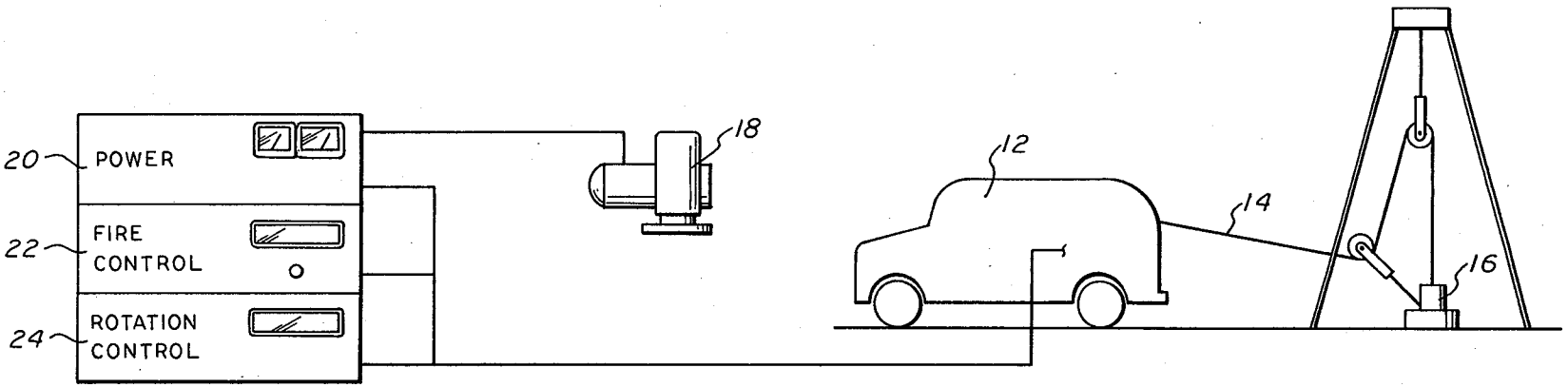
FIG. 3 is a schematic illustration of the surface equipment portion of an oil production system constructed in accordance with this invention.

Referring again to the drawings and, in particular, to FIG. 3, there is shown a winch truck 12 having a cable 14 that is capable of being extended from a storage reel therein, the winch truck also containing depth measuring equipment in order to properly locate the sonde with respect to the subsurface oil production formation intersected by the well bore. The cable 14 is extended through appropriate wire line sealing equipment at the wellhead 16 and the sonde 10 is lowered downwardly through the well casing by simply extending cable from the storage reel. Within an adjacent winch truck is also located a suitable source of electric energy, such as a generator 18 which is controllably coupled to power control circuitry 20, fire control circuitry 22 and rotational control circuitry 24.

Figure 4:
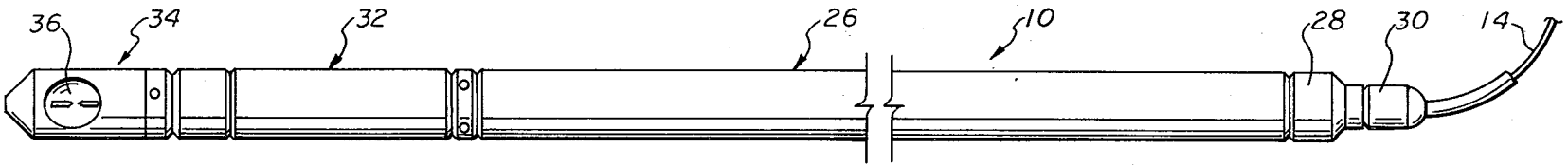
FIG. 4 is an elevational view of subsurface unit or sonde which is located with respect to the production formation and energized to cause electrohydraulic stimulation of the formation.

FIG. 4 is a view illustrating the sonde 10 and the major components thereof as adapted to be lowered into the well casing. The sonde 10 comprises a power supply assembly 26 that is supported by a cable head adapter 28 having a cable head 30 that establishes supporting electrical connection between the sonde and the electrical cable 14. The electrical cable may be in the form of a three conductor electrical well service cable, if desired, or the cable may incorporate additional conductors for power and control. Immediately below the power supply assembly of the sonde is located a rotary and discharge control assembly illustrated generally at 32 that provides rotational control for an energy projector head illustrated generally at 34 and having an energy projecting reflector 36 formed therein. This reflector, together with other components of a rotatable energy discharge head will be discussed in detail hereinbelow.

Figure 5A:
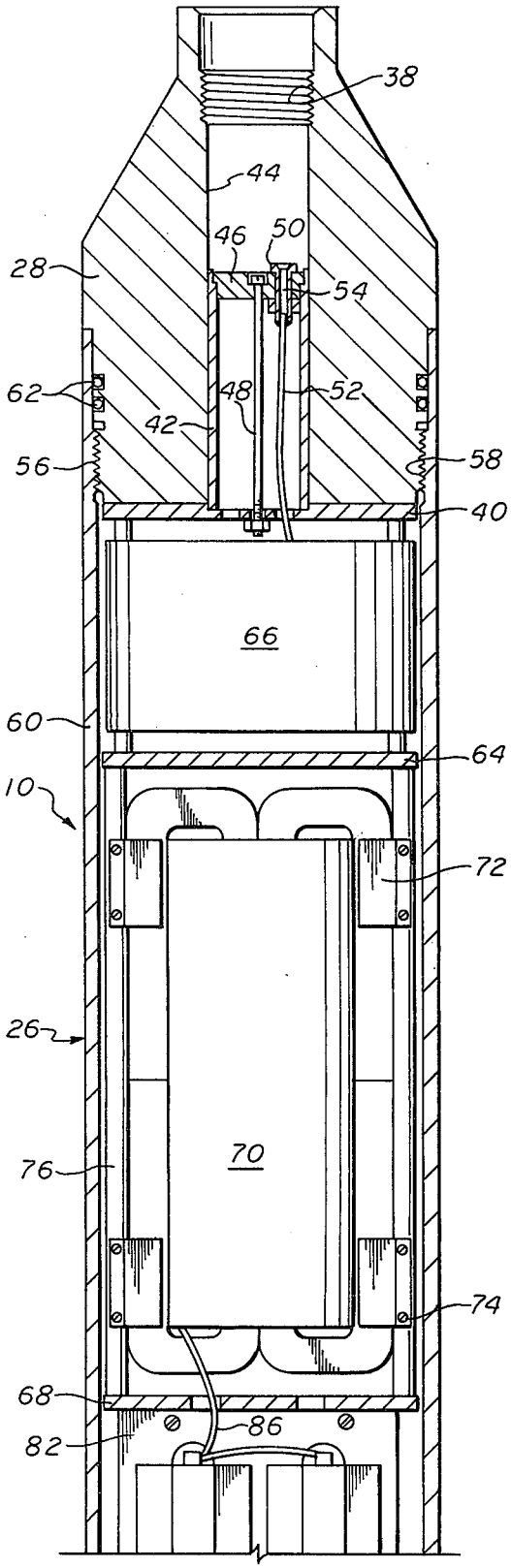
FIGS. 5*a*, 5*b*, 5*c* and 5*d* are partial sectional views of the sonde of FIG. 4, illustrating the internal structural and electrical components thereof in detail.
Figure 5B:
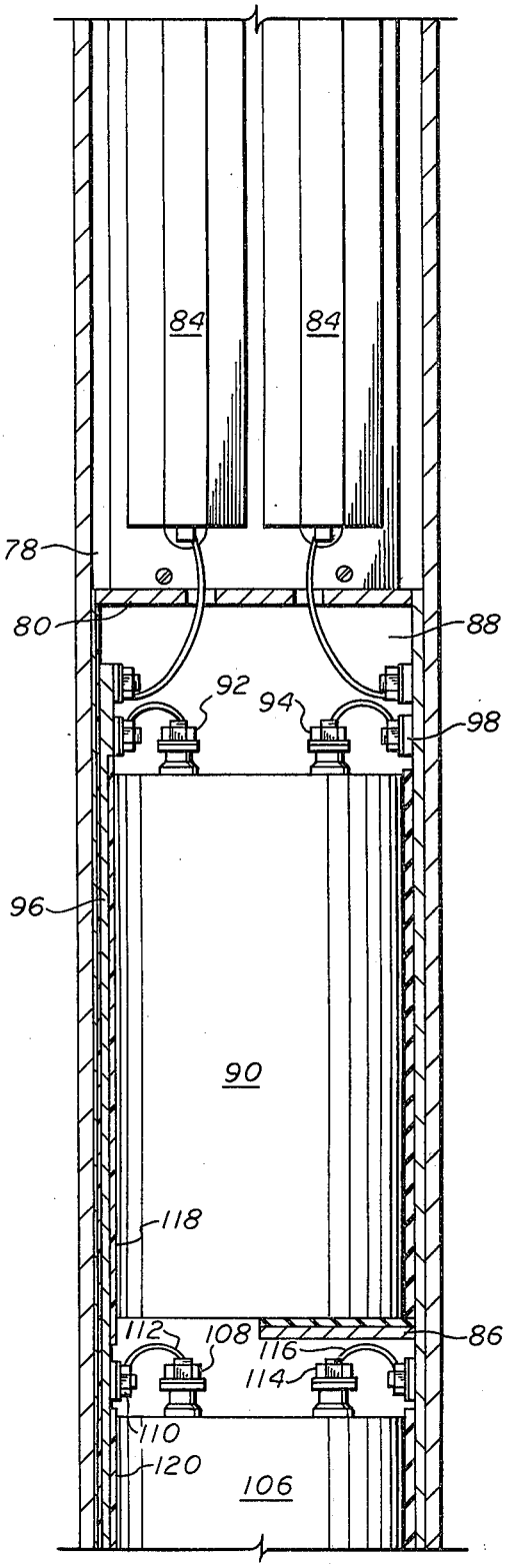
Figure 5C:
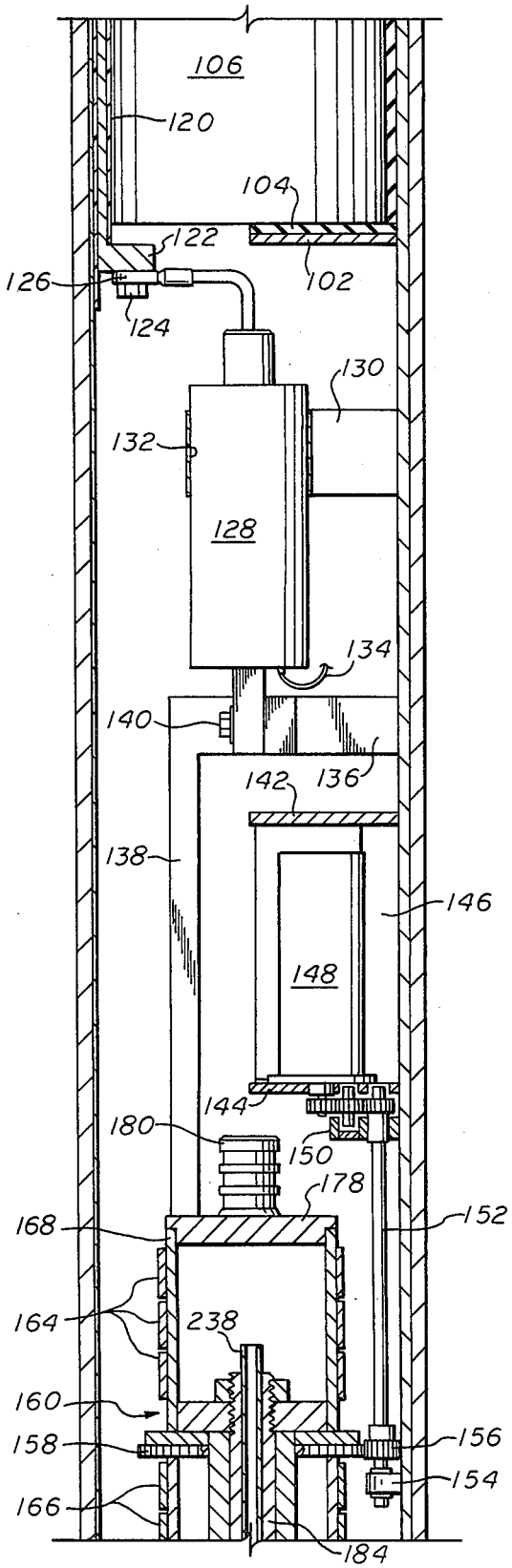
Figure 5D:
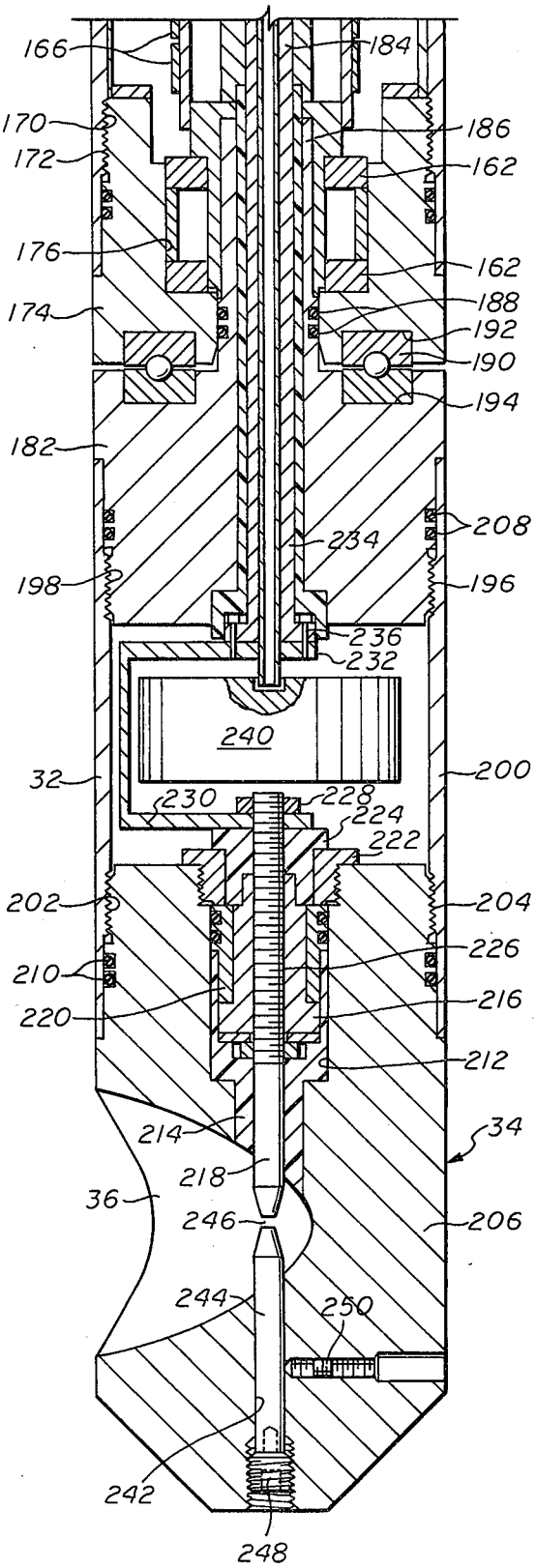

Referring now to FIGS. 5*a*, 5*b* and 5*c* for a more detailed understanding of the construction and operation of the sonde 10, in FIG. 5*a*, the cable head adapter 28 is shown to be formed with an internally threaded portion 38 at the upper extremity thereof. The cable head 30 which is in the form of an electrical connector, is adapted to be received by the threaded portion 38 to provide both support for and electrical connection between the service cable and the internal electrical components of the sonde. Immediately below the cable head adapter 28 there is provided a bulkhead 40 that receives an insulating connector element 42 of tubular form which projects upwardly into a bore 44 defined within the cable head adapter. An insulator plate 46 is received within the upper extremity of the insulating tubular element 42 and is secured relative thereto by means of a bolt 48 or other suitable connector element. A plurality of electrical connector elements, one of which is shown at 50, are interconnected with the insulating plate 46 and are also interconnected with respective ones of the electrical conductors 52 of the power and control circuitry. Each of the electrical connectors is formed to define an internal receptacle 54 within which connector pins of the cable head 30 are received for the purpose of establishing electrical connection between the conductors of the well service cable and the power and control conductors of the sonde.

The lower portion of the cable head adapter is formed to define an externally threaded portion 56 that is adapted to be received by an internally threaded portion 58 of an elongated tubular housing 60. O-rings 62, or other suitable sealing elements, establish a positive water-tight seal between the housing 60 and the cable head adapter 28 to provide protection for the internal electrical components of the sonde. Immediately below the bulkhead 40 and above an internal bulkhead 64 is located a charge/discharge control assembly illustrated generally at 66 and which is electrically connected with the power supply conductors 52 in the manner illustrated in the electrical schematic diagrams that are discussed in detail hereinbelow. Immediately below the bulkhead 64 and above another internal bulkhead 68 there is provided a transformer illustrated generally at 70 which is supported within the housing 60 by means of bracket elements 72 that are connected by screws 74 or by other suitable means of connection. Tie rod elements 76 are employed to position the transformer 70 with respect to the bulkhead elements 64 and 68 and with respect to the internal wall structure defined by the housing 60. The transformer 70 is properly positioned by the structural components including the brackets and tie rod elements within the transformer chamber defined between the bulkhead elements 64 and 68.

A rectifier chamber 78 is defined within the housing 60 between the bulkhead 68 and a lower bulkhead 80. An intermediate insulating partition 82 is positioned within the rectifier chamber and, in effect, divides the rectifier chamber into a pair of generally semi-cylindrical chambers. Rectifier elements such as shown at 84 are positioned within the rectifier chamber on either side of the insulating partition 82. Appropriate electrical conductors 86 interconnect the rectifiers with the output side of the transformer 70.

A lower bulkhead structure 86 is also positioned within the housing 60 and cooperates with bulkhead 80 to define an upper capacitor chamber 88 within which is received an upper capacitor 90 having capacitor terminals 92 and 94 that are interconnected respectively with a buss bar 96 and a terminal 98 that is affixed to an inner conductive housing 100. Another bulkhead 102 is shown to be positioned within the housing structure 60 and defines the lower wall of a lower capacitor chamber 104 within which is received a lower capacitor 106. One of the terminals 108 of the capacitor 106 is interconnected with the buss bar 96 by means of a lower terminal 110 and conductor 112. The other terminal 114 of the capacitor is connected by a conductor 116 to the inner conductive housing 100. Insulator elements 118 and 120 are employed to provide electrical insulation between the capacitor and the buss bar.

The buss bar 96 terminates with a lower connector terminal 122 that is adapted to receive a bolt 124 or other suitable connecting device to retain the connector terminal 126 of a switching device 128 which is also positioned within the inner housing of the sonde. A support mount 130 is connected to the inner housing 100 and provides a support receptacle 132 that is adapted to receive the switching device 128. Depending upon the desires of the user, the switching device 128 may conveniently take the form of a mechanical switch or a solid state switch. In either case, the switching device 128 is triggered by means of electrical energy introduced through an igniter conductor 134. Another mounting device 136 is shown to be connected to the inner housing structure 100 and provides structural support for a portion of the switching element 128 and also for a switch tube output buss 138 that is connected to the switching device by means of a bolt 140 or other suitable electrical connector element.

Immediately below the switching element 128 is positioned another bulkhead 142 which cooperates with the bulkhead 104 to define a switching tube section or chamber within which the switching element 128 is located. Below the bulkhead element 142 is positioned another bulkhead 144 that cooperates with bulkhead 142 to define a motor section or chamber 146 within which is positioned a motor assembly 148 that is adapted to drive a transfer gear assembly 150. The transfer gear assembly is adapted in turn to impart rotational movement to an elongated transfer or drive shaft 152 that is rotatably supported at the free extremity thereof by means of a bearing element 154 that is in turn supported within the inner housing 100. The transfer shaft 152 supports a gear element 156 that mates with a transfer gear 158 that is connected in nonrotatable relation with a slip ring assembly illustrated generally at 160, which slip ring assembly is rotatably supported within the housing structure by means of bearing elements 162. High voltage slip rings 164 and 166 are received by a rotatable, electrically conductive slip ring housing 168 and contact between the slip rings and respective ones of the high voltage power supply busses 138 is maintained. At the lower extremity of the housing 60 an internally threaded section 170 is formed which is adapted to receive the externally threaded upper portion 172 of an upper rotation sub 174. The sub 174 is formed to define an internal bearing receptacle 176 within which the rotation bearings 162 are retained to thus provide adequate support for the rotation subassembly, including the transfer gear and the electrical slip ring assembly. At the upper portion of the slip ring housing 168 is provided a transverse cap structure 178 defining a small slip ring assembly 180 that is adapted to provide for transfer of electrical control signals to the rotatable portion of the sonde. Appropriate electrical connection is established between slip rings supported by the slip ring assembly 180 and electrical control conductors that are interconnected with control circuitry maintained at surface control equipment.

Immediately below the rotation sub 174 is positioned a lower rotation sub 182 that is rotatably secured relative to the sub 174 by means of an elongated support shaft 184. The support shaft 184 is rotated along with the ring gear 158, thus inducing rotation of the lower rotation sub 182 relative to the upper rotation sub 174 and the housing of the sonde. The lower rotation sub 182 includes an upwardly projecting central portion 186 that extends through a central opening defined by the lower sub 174 and seal means 188 such as O-rings or the like are employed to establish a fluidtight seal between the upper and lower rotation subs. A bearing element 190 is received within opposed bearing pockets 192 and 194 defined respectively in the upper and lower rotation subs. Bearing assemblies 162 and 190 provide effective control and rotational support for the rotatable energy projector head illustrated generally 34.

The lower portion of the lower rotatable sub 182 is formed to define an externally threaded portion 196 that is adapted to be received by the internally threaded upper portion 198 of a lower housing section 200. The lower housing section also defines an internally threaded lower portion 202 that is adapted to receive the externally threaded upper portion 204 of an electrode support head 206. The housing section 200 is sealed with respect to the lower rotator sub 182 and the electrode support head 206 by means of seal assemblies 208 and 210 such as might be defined by O-rings or other suitable sealing elements. The electrode support head 206 is formed internally to define an electrode receptacle 212 within which is received an insulator element 214 and an electrode holder element 216. The electrode holder provides support for an electrode element 218 that is positioned with the lower extremity thereof oriented within the cavity defining the energy projecting reflector 36. Insulating retainer elements 220 and 222 function to retain the electrode support structure 216 within the receptacle 212 and a retainer element 224 is threaded into the upper threaded portion of the receptacle 212 and functions to retain the electrode assembly in properly positioned manner within the receptacle. The position of the electrode 218 relative to the energy projecting reflector 36 is adjustable by means of an adjustable threaded inner connection between the electrode and the electrode holder 216, as shown in broken line at 226. A lock nut 228 is received by the upper threaded extremity of the electrode 218 and functions to lock the electrode relative to the electrode holder 216 and further to secure an electrical bypass buss 230 to the electrode. The upper portion 232 of the bypass buss is secured to a lower flange portion 234 of the elongated shaft 184 by means of a plurality of bolts 236. An insulator element 238 extends through an axial bore formed in the elongated shaft or feedthrough buss 184 and the insulator 238 is of tubular form establishing a bore through which electrical conductors may be extended for the purpose of establishing electrical connection with a nonrotatable rotation sensor mechanism 240. The purpose of the sensor mechanism 240 is for accurately determining the position of the rotatable head 34 and the energy projecting reflector 36. The head 34 may then be accurately oriented in order to selectively project energy into the formation in any suitable manner.

The lower portion of the electrode support head 206 is also formed to define an electrode receptacle 242 within which is positioned a lower electrode element 244 having the upper extremity thereof positioned within the cavity defining the energy projecting reflector 36. The upper and lower electrodes are positioned such that the free extremity thereof are positioned in closely spaced relation with one another, defining a spark gap 246 where the electrical detonation originates. Retainer screws 248 and 250 are employed to secure the lower electrode 244 in place within its receptacle.

The direction of the energy projecting reflector 36 is oriented through actuation of the motor 148 which rotates the gear train 150 and transfer shaft 152, causing the gear element 156 to rotate the transfer gear 158. When this occurs, the housing 168 is rotated and the elongated support shaft and feedthrough buss 184 is rotated, causing consequent rotation of the bypass buss 230 that interconnects the high voltage electrical circuitry with the upper electrode 218. The bypass buss 230 remains stationary relative to the rotation section 34 and electrode support head 206 but rotates along with these elements responsive to rotation of the energy projector head 34 relative to the rotation and discharge control assembly 32 of the sonde mechanism.

Although the sonde is shown in FIGS. 5*a*, 5*b* and 5*c* as incorporating a rotational control mechanism for accurate positioning of the energy projecting reflector 36, it is not intended to restrict the present invention to utilization of a head rotating mechanism. In the alternative, the invention may incorporate a sonde mechanism incorporating identical power and firing circuitry but having an energy projecting head that is stationary with respect to the housing structure of the sonde. In this case, it will be desirable to provide means for accomplishing rotation of the sonde within the well bore so as to achieve desirable positioning of the energy projecting reflector. As a further alternative, the energy projecting reflector may conveniently take the form of a reflector system wherein the energy of detonation is radiated 360° during each firing sequence. In such case, it would not be necessary to achieve rotation of the sonde or any part thereof within the well bore. The sonde, in this case, is of non-rotatable construction and the spark gap designed to achieve 360° radiation of energy.

Figure 6:
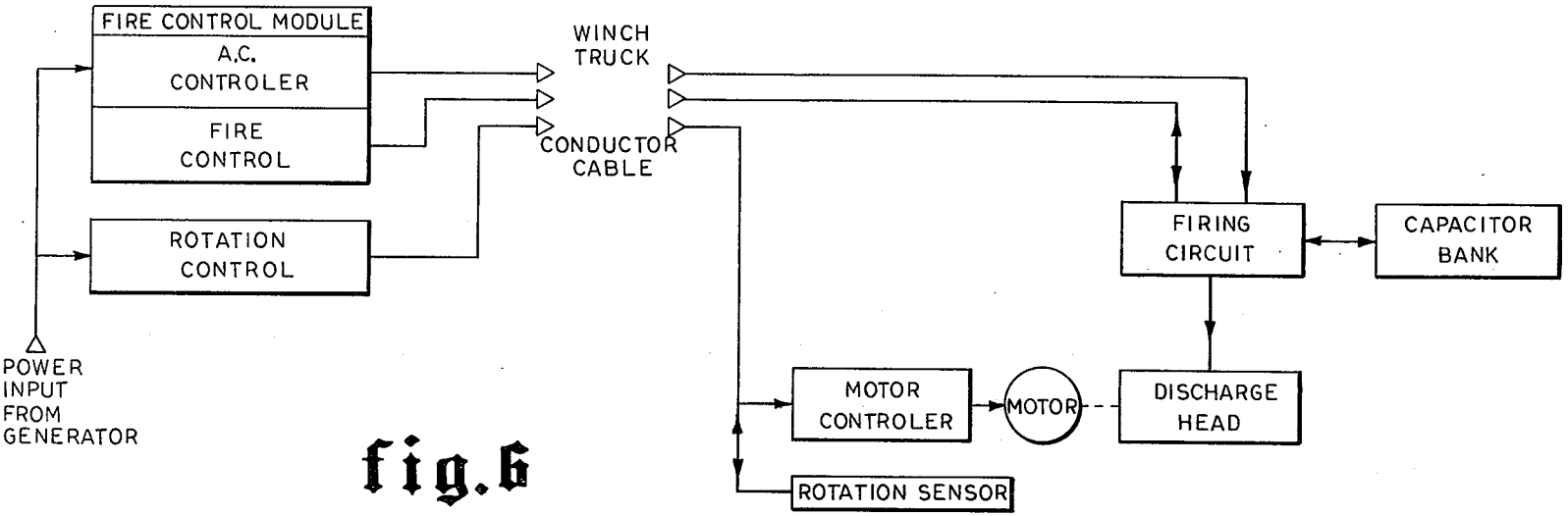
FIG. 6 is an electrical schematic illustration showing in block diagram form the circuitry of the control panel and sonde.

Referring now to the electrical circuitry and particularly FIG. 6, there is shown a block diagram of the electrical circuitry of one form of the invention wherein electrical power is received from a power supply S which is interconnected with a fire control module having an AC controller and a fire control circuit and is also interconnected with a rotation control circuit. The output conductors 252, 254 and 256 of these circuits are connected, respectively, to lines 1, 2 and 3 of a three conductor well control cable which is illustrated in FIG. 4 at 14. The well control cable 14 extends to the sonde with lines 1 and 2 being interconnected with a firing circuit having a capacitor bank and thence to a discharge head for generation of the electrical spark detonation. The discharge head is energized by means of a motor and motor controller circuit for positioning of the discharge head in the manner indicated above. A rotation sensor is also employed to ensure proper positioning of the discharge head relative to the body of the sonde.

Figure 7:
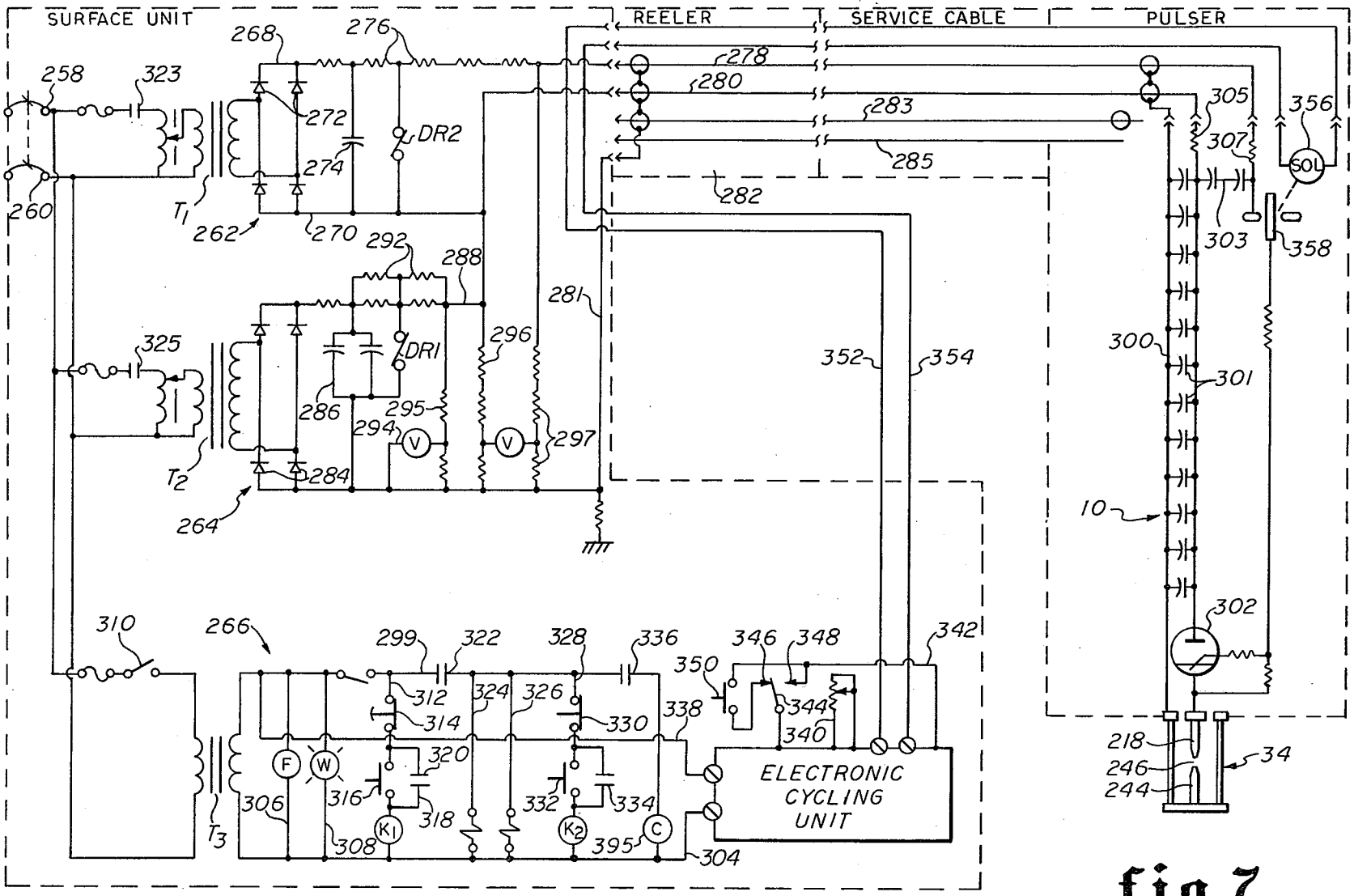
FIG. 7 is an electrical schematic circuit diagram illustrating in more specific detail the electrical circuitry embodied in the invention.

FIG. 7 is a schematic illustration of the electrical circuitry incorporated within the surface power and control units and the sonde, which is adapted to be positioned in remote relation to the power and control circuitry. Electrical energy such as is supplied by the generator 18 of FIG. 3 is coupled to circuit connectors 258 and 260 and energizes a transformer incorporating transformer windings T1, T2 and T3, with winding T1 being incorporated within an ignitron power supply circuit while winding T2 is incorporated within a main bank power supply circuit. Transformer winding T3 is coupled with a control circuit illustrated generally at 266 that provides for both automatic and manual control of the firing sequence of the sonde as desired.

With regard to the ignitron power supply circuit 262, conductors 268 and 270 are coupled to diodes 272 and constitute a bridge rectifier which steps up the AC voltage to a DC voltage. A filter capacitor 274 is coupled across the conductors 268 and 270 to provide constant voltage to the ignitron power supply system. A series of limiting resistors 276 are coupled to conductor 268 to prevent any short circuit current from exceeding the current carrying capacity of the service cable. A conductor 280 of the service cable is coupled with conductor 270 which extends from the cable reel mechanism 282 to the sonde, which is illustrated generally at 10.

The main bank power supply circuit 264 incorporates rectifier bridge diodes 284 and a filter capacitor circuit 286 for the purpose of supplying a constant DC voltage to power supply conductors 288 and 290. Limiting resistors 292 are coupled across conductors 288 and 290 to prevent any short circuit current from exceeding the current carrying capacity of the service cable and limits the charging current to a reasonable value for the power supply and bridge rectifiers, capacitor bank 300 incorporating a number of parallel connected capacitors 301. Dump relay controlled switches DR1 and DR2 function in concert to provide for charging of the capacitor bank. The dump relay switches are provided to protect the power supply and the capacitor bank after pulser operations are terminated. These relay switches are open when sequencing of the pulser is initiated and thus protect the power supply and capacitor bank to provide high voltage when the high voltage relay is activated. Autotransformers and variable transformers are also provided so that the main bank and injector power supply voltages can be adjusted independently, thus providing exceptional flexibility. When the high voltage relay is energized, power is provided to the contors $DR_1$ and $DR_2$, thus bringing on line power such as 240 volts AC which is stepped up by the transformers and then rectified to provide DC voltage for charging of the main and injector capacitor banks. The control panel 266 is provided with various adjustment circuits for adjusting the autotransformers and variable transformers to thus achieve desired adjustment of the voltage. Metering circuits are employed for both the main bank power supply and the injector power supply. A main bank metering circuit is shown at 294 having a voltmenter V1 and metering resistors 295. A differential metering circuit is shown at 296 which incorporates a voltmeter V2 coupled across two series circuits incorporating injector resistors 296 and main bank resistors 297. The differential metering circuit measures the injector voltage independent of the main bank voltage so that the injector voltage is known at all times. This feature is important because the injector voltage does not vary as the main bank voltage varies.

The shielded service cable extends from the surface electronic unit down through the well bore to the sonde which is located at or near the subsurface formation to be produced. The cable incorporates shielding which is coupled to a common conductor 281 and also incorporates spare conductors 283 and 285 that may be employed in the event of failure of a power or control conductor. The cable will typically be several thousand feet in length and therefore offers substantial resistance and inductance to rapid firing of capacitors and development of an explosive-like discharge across a spark gap. In accordance with a primary principle of this invention, electrical energy is transferred from a surface based power supply facility down through the service cable at a voltage well within the capacity of the service cable. This voltage is then stored in a main capacitor bank until a suitable value is accumulated. The capacitor bank is located in the same sonde unit as the spark gap and is activated to selectively and simultaneously discharge the capacitors across the spark gap at a current flow that greatly exceeds the current carrying capacity of the service cable. The unique result therefore is transmission of electrical energy to the sonde at a reasonable low charging rate and development of an electrical explosive spark that releases sufficient explosive energy to develop efficient sonic wave propogation a great distance into the subsurface formation.

The capacitor bank 300 incorporates a suitable number of large magnitude parallel connected capacitors 301 which place an electrical bias on an ignitron 302 that is directly coupled with the electrode 218. Upon activation of the ignitron, the stored energy of the capacitors 301 discharge simultaneously into electrode 218 across the spark gap 246 to the electrode 244, thus generating an explosive spark discharge across the spark gap and releasing the desired explosive energy.

For controlling discharge of the capacitor bank or pulser, a pulser control system is employed which may be activated selectively in the event manual firing is desired or may be activated under the control of an electronic cycling unit when automatically controlled firing is desired. The pulser incorporates the capacitor bank 300 ignitron switch 302, spark head 34 and an injector capacitor bank 303 having series coupled capacitors. For spark gap preparation, the voltage of the series coupled capacitors causes increase of the main bank voltage to an injector level and have the function of breaking down the resistance of the spark gap initially and thus renders the spark gap conductive. The conductive spark gap then allows sudden, explosive discharge of the charge of the main capacitor bank across the spark gap. The spark gap switch 358 is first exhausted by energizing the solenoid valve 356, allowing the spark gap to be selectively pressurized or depressurized as is appropriate for spark ignition. When the spark gap is depressurized, the series injection capacitors 303, which can be in the order of eight microfareds each, are discharged, causing a voltage to appear across the electrodes 218 and 244. This voltage for example may be in the order of 30 kilovolts. When the voltage across the electrodes causes the spark gap to break down the ignitron switch 302 is then caused to fire, unloading the main capacitor bank 300 into the developed spark channel which has been developed across the electrode and spark gap switch. Thus, the storage energy of the capacitor bank is suddenly unloaded into the spark channel during a short or substantially instantaneous period of time, such as about 10 microseconds, for example, which enters the already developed spark channel and develops a violent, ablative explosion that is transmitted through coupling fluid typically surrounding the sonde and thence into the formation to induce production of oil contained therein.

The injector power supply described above funtions to charge the series capacitors 303 of the injector system and the main power supply functions to charge the bank 300 of parallel capacitors. As an example, the main capacitor bank may be charged to about 10 kilovolts and the injector capacitors may be charged to about 20 kilovolts, placing a total of the injector and main bank voltages at a level of about 30 kilovolts to break down the spark gap.

The control circuitry 266 incorporates conductors 299 and 304 that are coupled with the step-down transformer T3 which reduces the 240 volt AC current to 100 volt AC and provides power for the various control circuit activities. For example, a cooling fan circuit 306 is coupled across the conductors 299 and 304 and a power indicator light circuit 308 provides a visual indication that the control circuitry is energized upon closing of the power control switch 310. A relay activation circuit 312 is employed incorporating a stop switch 314 and a relay activation switch 316 that control energization of the relay K1. A holding circuit 318 incorporating relay controlled switch 320 is provided to continuously energize the circuit 312 after closing of the switch contact 316. When pushbutton switch 316 is closed, relay $K_1$ is activated, causing relay contact $K_1$ to latch through the holding circuit 318. This activates the dump relays $DR_1$ and $DR_2$ and thus enables the high voltage to be turned on. A relay controlled contact 322 activated by relay K1 is provided to control energization of circuit conductor 299. As relay $K_2$ is energized, it closes normally open relay contacts 323 and 325 and thus causing the primary windings of transformers $T_1$ and $T_2$ to be energized and thus placing high voltage on both the main bank and injector power supply systems. A main bank dump relay circuit 324 and an injector dump relay circuit 326 are also coupled across conductors 299 and 304 for respective control of dump relay contacts DR1 of the main bank power supply circuit 264 and DR2 of the injector power supply circuit 262. A high-voltage relay circuit 328 is further coupled across conductors 299 and 304 of the control circuit 266 and incorporates a normally closed high-voltage "off" switch 330 and a normally open high voltage "on" relay activation switch 332. Relay contacts 334 and 336 are closed upon energization of relay K2, thus allowing control power to be introduced into an electronic cycling unit by means of energized control conductors 304 and 338. A potentiometer circuit 340 is interconnected with the electronic cycling unit and is adjustable to control the repetition rate or cycling rate of the cycling unit and thus controlling repetitions of spark energized introduction of energy into the oil bearing formation. The electronic cycling circuit also incorporates an automatic or manually controlled firing circuit 342 having a mode switch 344 that enables the user to select either the manual or automatic firing modes by positioning of the switch 344 relative to mode contacts 346 and 348. With the mode switch 344 engaging contact 346, the circuit incorporating a firing switch 350 is energized and the user may cause selective single shot firing of the spark head simply by selectively depressing the firing switch 350. With the mode switch 344 engaging the automatic cycling contact 348, firing of the spark head will be induced by the electronic cycling circuit responsive to the rate set by the potentiometer circuit 340. Output conductors 352 and 354 are coupled through the service cable to a solenoid 356 which activates a switch 358 in such manner as to cause firing of the ignitron 360. When firing occurs, each of the capacitors in the capacitor bank 300 will be simultaneously discharged across the upper and lower electrodes 218 and 244, thus inducing a spark detonation to occur at the spark gap 246 between the electrodes.

Figure 8:
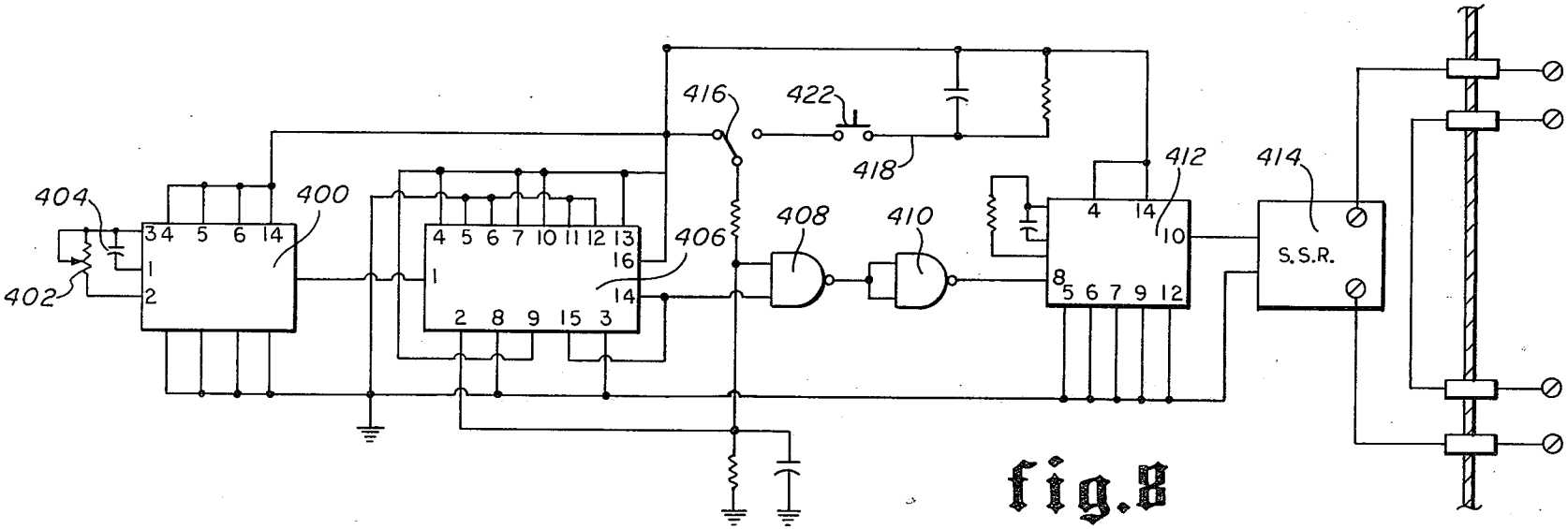
FIG. 8 is an electrical schematic diagram illustrating the electronic circuitry of the electronic cycling unit of FIG. 7.

The electronic cycling unit may conveniently take the form illustrated in FIG. 8 wherein an "A" stable multivibrator circuit 400 is provided, having operating periods that are controlled by an RD network including a repetition rate potentiometer 402 and a timing capacitor 404. The output of the "A" stable multivibrator circuit, having a frequency of about 80 to 90 milliseconds or 0.08 to 0.09 seconds, is coupled with a division circuit 406 whereby the oscillator output is divided by a suitable number such as 100, for example, thus yielding a timed period of about 8 or 9 seconds. Logic gate circuits 408 and 410 receive and process the output of the division circuit with the output thereof being received by a monostable oscillator circuit 412 that determines the timing sequence of the solenoid valve 356. A solid state relay 414 is activated and deactivated by the timing sequence oscillator 412 and thus controls energization of the solenoid valve 356.

The electronic cycling unit includes a manual-/automatic selector switch 416 enabling the operator to select a manual firing circuit 418 or an automatic firing circuit 420. In the manual mode, a push button switch 422 controls the energization of the manual firing circuit 418, thus allowing the operator to energize the solid state relay 414 directly through the timing sequence oscillator 412 for manual operation of solenoid valve 356 to cause depressurization of the spark gap switch. In the automatic mode of switch 416, circuit 420 is energized and circuits 400, 406, 408, 410 and 412 achieve timed automatic sequencing of the solid state relay 414 in accordance with the adjustment setting of the potentiometer 402. To minimize the complexity of the electronic circuitry, the oscillator 400 is operated at high frequency and the frequency pulses are divided by the divider circuit and then counted to provide quite controllable timing sequence which, for example, may have a timing range of from 10 seconds to about 100 seconds.

By pulsing the solid state relay with the monostable oscillator, the solenoid valve is energized at the proper time and proper duration to ensure optimum firing of the pulser. The solenoid valve is energized for about one second and is exhaused in about 1/10 second, therefore providing sufficient time overlap to become exhausted and ready for recharge. The timing sequence, which is in the order of 10 seconds or more, is then initiated to allow the pulser to become fully charged. The time then again pulses the solid state relay 414 after the 10 second period to again exhaust the solenoid valve. The monostable oscillator circuit is self-controlled by its timing network to become energized for one second then delayed for 10 seconds and then again energized for one second in continuous cycling. This provides the holding time for proper operation of the solenoid valve. The logic gate circuits enable the monostable oscillator to operate only in the automatic mode and not in the manual mode. When the manual fire switch is closed and with switch 416 in the manual mode, the monostable oscillator will function in single shot capacity in the same manner as under automatic sequencing, but with only a single cycle. If the pushbutton firing switch 422 is held closed or again closed before the cycle has ended, firing will not occur. The single cycle monostable oscillator will not count a second time before the end of a timing sequence because of a large resistor which is connected around a rather small capacitor in the order of 0.1 mfd.

It should be noted that the electrical circuitry illustrated in FIG. 7 does not incorporate any mechanism for accomplishing selective or automatic rotation of the energy projector head. It is to be understood, therefore, that the power and control circuitry of FIG. 7 may be incorporated within a sonde mechanism wherein the sonde itself is rotated to position the energy projecting reflecter in desirable manner relative to the formation to be produced. The electronic circuitry of FIG. 7, however, may be efficiently incorporated in conjunction with other circuitry providing the capability for activation of a rotatable energy projector head such as is illustrated in FIG. 4 and FIG. 5c.

The pulser system is incorporated within a coaxial tube and the capacitors of the capacitor bank are cylindrical and are assembled so that the pulser system is completely coaxially contained within the tubing. The pulser is constructed in the form of a pulse forming network so that the distributed inductance and capacitance of each stage provide a pulse that approximates a square wave. The pulser then unloads its energy into the load of the spark, which is in the order of 50 milliohms after the injector breaks down the spark. The load is matched so that the most amount of energy is transferred into the spark gap in the shortest amount of time to form an optimum shock wave. The mechanical and electrical aspects of the pulser are therefore considered mutually necessary to accomplish matching of the pulse forming network of the capacitor bank to the load impedence for maximum energy transfer. The close physical proximity of the capacitor bank and spark gap promotes this effective matching.

Under circumstances where it is desired to provide power and control circuitry for a sonde similar to that illustrated in FIG. 4 and to provide for rotation of an energy projector head thereof, the electronic circuitry may conveniently incorporate simple power and control circuitry for accomplishing operation of the rotation motor 148.

By controlled introduction of electrohydraulic energy into an oil bearing formation, the oil retention characteristics of the formation are changed and the oil will be released and prepared for migration through the formation. The energy introduced into the formation is in the form of shock waves and hydraulic waves, traveling through the formation at different velocities which prepare the crude oil for migration by releasing formation adhesion and then forcibly propel the oil through the formation away from the point of energy introduction. The oil migrates to adjacent well bores and is collected in conventional manner.

This invention is therefore well adapted to attain all of the objects and features set forth hereinabove, together with other objects and features that are inherent in the oil production system identified herein and the apparatus shown in the accompanying drawings. It will be understood that certain combinations and subcombinations are of utility and may be employed without reference to other features and subcombinations. This is contemplated by and is within the scope of the present invention.

As many possible embodiments may be made of this invention without departing from the spirit or scope thereof, it is to be understood that all matters hereinabove set forth or shown in the accompanying drawings are to be interpreted as illustrative and not in any limiting sense.

I claim:

1. A process for stimulating recovery of crude oil from oil bearing earth formations wherein such oil is incapable of migrating through the formation in commercially producing quantity, said process comprising:

locating a pair of electrodes within a well bore, said electrodes being in spaced relation and defining a spark gap therebetween;

developing first and second electrical charges substantially at the level of the oil bearing earth formation;

releasing said first electrical charge into said spark gap to render said spark gap conductive;

releasing said second electrical charge into said conductive spark gap to generate said explosive spark;

said explosive spark introducing intense shock waves into said oil bearing formation at the level of said formation, said electrical spark generated shock waves being of sufficient magnitude to modify the oil retention quality of said formation sufficiently to release a substantial quantity of oil from the adhesion thereof to the formation;

introducing hydraulic waves into said oil bearing formation at the level of said formation, said hydraulic waves being generated by said electrical spark simultaneously with said shock waves and traveling through said formation at a rate of speed that is slower as compared to the speed of said shock waves; said hydraulic waves inducing released oil to migrate forcibly away from the point of energy introduction of said shock waves and hydraulic waves; and producing the migrating oil from adjacent collection wells positioned in spaced, surrounding relation with said point of energy introduction into said formation.

2. A process as recited in claim 1, wherein introduction of said shock waves and hydraulic waves into said formation is accomplished by:

locating said pair of electrodes within said well bore substantially at the level of said oil bearing earth formation, said electrodes defining a spark gap and having an electric circuit including an injector capacitor bank for development of said first electrical charge and a main capacitor bank for development of said second electrical charge placing high-voltage charges on the capacitors of said injector capacitor bank and said main capacitor bank by charging of said capacitor banks from a surface located source of electrical energy until capacitor charges of predetermined magnitude have been obtained;

suddenly and sequentially discharging the capacitors of said injector capacitor bank and main capacitor bank across said spark gap and causing spark gap preparation and spark detonation, said spark detonation simultaneously developing a shock wave and a hydraulic wave; and repetitively charging said capacitor banks from said surface located source and sequentially discharging said capacitor banks across said spark gap to introduce repetitive shock and hydraulic waves into said formation.

3. A process as recited in claim 2, wherein:

repetitive charging and discharging of said capacitor banks across said spark gap and said capacitor charge of predetermined magnitude is controlled in accordance with the characteristics of said spark gap and said formation to enhance the maximum effective volume of oil migration within said formation.

4. A process as recited in claim 2, including:

introducing said shock and hydraulic waves into said formation in the form of a focused narrow angle beam; and selectively orienting said focused narrow beam during said repetitive charging and discharging of said capacitor bank across said spark gap and selectively directing the energy of said spark detonation into said formation in the form of a selected pattern.

5. A process as recited in claim 2, wherein said spark detonation is achieved by:

suddenly discharging a plurality of high voltage capacitors across a spark gap.

6. A process as recited in claim 1, wherein:

said shock waves are of sufficient intensity to develop fracturing within said formation.

7. A process as recited in claim 6, wherein:

shock and hydraulic wave forms are selected relative to the density and composition of the oil bearing formation such that the degree of fracturing in the formation is extensive and the resulting particles are small.

8. A process as recited in claim 1, wherein said process includes:

selectively controlling the frequencies and amplitudes of said shock waves and said hydraulic waves relative to the density characteristics of the formation and the viscosity of the oil contained within the formation.

9. A process as recited in claim 1, wherein said electrodes are positioned within an energy focusing recess and said process includes:

rotating said energy focusing recess during repetitive charging and discharging of said capacitor bank across said spark gap and developing controllably oriented focused narrow beams of shock wave and hydraulic wave energy and directing said wave energy into said formation to achieve maximum propagation of said shock waves and hydraulic waves into said formation and to reach the formation surrounding the point of energy introduction into said formation.

10. Apparatus for generating electrohydraulic waves and shock waves in an oil bearing formation, said apparatus comprising:

elongated housing means of sufficiently limited external diameter to allow easy insertion of said housing means into the well pipe of an oil well intersecting an oil bearing earth formation;

adapter means defined at the upper extremity of said housing means for supporting connection of said housing means with housing support means;

a pair of electrodes being supported by said housing means with the extremities of said electrodes positioned in spaced relation to one another and defining a spark gap;

a main capacitor bank circuit being contained within said housing means and being electrically interconnected with said electrodes said main capacitor bank circuit incorporating a plurality of parallel related capacitors;

an injector capacitor bank being coupled with said main capacitor bank and increasing the voltage of said main capacitor bank to an injector level for breaking down the resistance of said spark gap; and an ignitron switch being coupled with one of said electrodes and said main capacitor bank, said ignition switch firing upon breaking down of the resistance of said spark gap by said voltage of said injector capacitor bank and conducting the stored electrical energy of said main capacitor bank into said spark gap to cause spark detonation; and means controlling charging and discharging of said injector and main capacitor banks in accordance with the characteristics of said oil bearing formation and the viscosity of crude oil contained therein and developing a controlled spark detonation at said spark gap, which spark detonation develops shock waves and hydraulic waves in said oil bearing formation of controlled frequency and amplitude for releasing oil from the adhesion thereof with said formation and causing said oil to flow in a direction away from said spark gap.

11. Apparatus as recited in claim 10, wherein:

an energy projecting reflector is defined by said housing means, said electrodes being oriented to position said spark gap within said reflector, said energy projecting reflector causing concentration of the induced energy of said spark detonation within a narrow unidirectional band.

12. Apparatus as recited in claim 11, including:

means for rotating and positioning said energy projecting reflector within said well and causing directionally selective introduction of said shock waves and hydraulic waves into said formation.

13. Apparatus as recited in claim 12, wherein said means for rotating and positioning said energy projecting reflector comprises:

a portion of said housing means defining said energy projecting reflector and being rotatably supported by the upper portion of said housing means; and means within said housing means for inducing controlled rotation and positioning of said rotatable housing portion.

14. Apparatus as recited in claim 12, wherein said means for rotating and positioning said energy projecting reflector comprises:

rotation control means being located at the surface of said well and being electrically interconnected with said elongated housing means; and rotation means being interconnected with said elongated housing means and adapted to cause selective rotation and positioning of said elongated housing means responsive to activation of said rotation control means.

15. Apparatus as recited in claim 10, wherein:

a rectifier circuit is incorporated within said housing means and is electrically coupled with said capacitor circuit;

transformer means is incorporated within said housing means and is electrically coupled to said rectifier circuit;

charge and discharge control means is incorporated within said housing means, is electrically coupled to said transformer means and is adapted to be electrically coupled to power supply and control circuitry extending from said housing means to the surface of said well for connection with electrical power supply means.

16. A method of developing shock and hydraulic waves by explosive-like ablative electrical spark across a spark gap defined by electrodes positioned in a well bore near a subsurface earth formation from which crude oil is to be produced, said method comprising:

providing a source of electrical energy at the earth's surface;

transmitting electrical energy through a service cable extending from the earth's surface to a location near said subsurface earth formation, said energy transmission being at a rate within the transmission capability of said service cable;

storing electrical energy in a main capacitor bank at said location and developing an electrical charge of high magnitude;

storing electrical energy in an injector capacitor bank at said location at a maximum injector voltage level exceeding the voltage level of said main capacitor bank and being sufficient to render said spark gap conductive;

selectively discharging said stored electrical energy of said injector capacitor bank across said spark gap to render said spark gap conductive; and suddenly discharging said electrical charge across said spark gap defined by spaced electrodes with the rate of energy transmission of said discharging greatly exceeding the energy transmission capability of said service cable.

17. A method as recited in claim 16, wherein:

said storing of energy is accomplished by charging a capacitor bank incorporating a plurality of capacitors interconnected in parallel.

18. A method as recited in claim 17, wherein said method includes:

repetitively charging said capacitor bank and discharging said capacitor bank across said spark gap in accordance with a timed sequence of selected duration.

19. A method as recited in claim 18, including:

breaking down the resistance of said spark gap with said injector voltage to render the spark gap conductive prior to suddenly discharging said electrical charge into said conductive spark gap.

20. A method as recited in claim 16, wherein:

said capacitor bank is located in close proximity to said spark gap and said sudden discharge of electrical energy is conducted directly from said capacitor bank to said spark gap by an ignitron controlled electrode buss.

21. A process for stimulating recovery of crude oil from oil bearing earth formations wherein such oil is incapable of migrating through the formation in commercially producing quantity, said process comprising:

locating a pair of electrodes within a well bore, said electrodes being in spaced relation and defining a spark gap therebetween;

developing a main capacitor bank voltage substantially at the level of said oil bearing earth formation and providing said main capacitor bank voltage at said spark gap;

developing an injector capacitor bank voltage in the immediate vicinity of said main capacitor bank voltage;

increasing said main capacitor bank voltage to an injector level by means of said injector capacitor bank voltage to initially break down the resistance of said spark gap and render said spark gap conductive;

discharging said main capacitor bank voltage into said conductive spark gap to generate said explosive spark;

said explosive spark introducing intense spark generated shock waves into said oil bearing formation at the level of said formation, said electrical spark generated shock waves being of sufficient magnitude to modify the oil retention quality of said formation sufficiently to release a substantial quantity of oil from the adhesion thereof to the formation;

introducing hydraulic waves into said oil bearing formation at the level of said formation, said hydraulic waves being generated by said electrical spark simultaneously with said shock waves and traveling through said formation at a rate of speed that is slower as compared to the speed of said shock waves; said hydraulic waves inducing released oil to migrate forcibly away from the point of energy introduction of said shock waves and hydraulic waves; and producing the migrating oil from adjacent collection wells positioned in spaced, surrounding relation with said point of energy introduction into said formation.

* * * * *